US008279077B1

(12) United States Patent
Liff et al.

(10) Patent No.: US 8,279,077 B1
(45) Date of Patent: Oct. 2, 2012

(54) RADIO FREQUENCY-BASED PROXIMITY DETECTION SYSTEM

(75) Inventors: Dale Liff, Kent, OH (US); Richard E. Benson, Mentor, OH (US)

(73) Assignee: AVID Technologies, Inc., Twinsburg, OH (US)

( * ) Notice: Subject to any disclaimer, the term of this patent is extended or adjusted under 35 U.S.C. 154(b) by 512 days.

(21) Appl. No.: 12/611,726

(22) Filed: Nov. 3, 2009

Related U.S. Application Data

(60) Provisional application No. 61/110,866, filed on Nov. 3, 2008, provisional application No. 61/255,369, filed on Oct. 27, 2009.

(51) Int. Cl.
*G08B 21/00* (2006.01)

(52) U.S. Cl. ..... 340/686.6; 340/539.23; 340/686.1

(58) Field of Classification Search ..... 340/686.6, 340/539.1, 539.13, 539.23, 541, 686.1, 3.1, 340/4.36, 5.1, 5.31; 324/681
See application file for complete search history.

(56) References Cited

U.S. PATENT DOCUMENTS 7,259,671 B2 * 8/2007 Ganley et al. ..... 340/539.23
8,102,269 B2 * 1/2012 Boehm et al. ..... 340/573.4

* cited by examiner

*Primary Examiner* — Toan N Pham
(74) *Attorney, Agent, or Firm* — Ulmer & Berne LLP

(57) ABSTRACT

A detection system includes a base station and a sensor. The base station defines a detection area and is configured to transmit a detection signal at a first frequency. The base station is further configured to facilitate selective variation of the detection area. The sensor is configured to detect the detection signal and transmit a communication signal at a second frequency in response to the detection signal. Movement of the sensor between the detection area and an area outside of the detection area affects detection of the detection signal. The first frequency is less than the second frequency.

29 Claims, 12 Drawing Sheets

RADIO FREQUENCY-BASED PROXIMITY DETECTION SYSTEM

REFERENCE TO RELATED APPLICATIONS

This application claims priority to, and the full benefit of U.S. Provisional Patent Application Ser. Nos. 61/110,866, filed Nov. 3, 2008 and 61/255,369, filed Oct. 27, 2009. The entire disclosures of these applications are incorporated into this document by reference as if fully rewritten below.

TECHNICAL FIELD

The systems and methods disclosed in this document relate generally to the field of control systems and more specifically to the field of detection of proximity as a means of control.

BACKGROUND

Control systems can include a variety of mechanisms and methods to detect proximity of a target object to a base. In some cases, the target object can be a human operator of an industrial machine such as a cutting tool or press. In other cases, the target object can be some item that may be moved or carried away. Other applications for which a need or desire to monitor proximity of some person or object relative to another position also exist or can be created.

During operation of an industrial machine, an operator may be positioned nearby to monitor and control its operation. At times, the operator may need to approach the industrial machine. In this case, the industrial machine can be equipped with a proximity sensing system that monitors the position of the operator. If the operator moves too close to the industrial machine during operation, or in other cases, too far away from the machine, the proximity detection system can power down the industrial machine to prevent harm to the operator.

SUMMARY

In accordance with one embodiment, a detection system comprises a base station and a sensor. The base station defines a detection area and is configured to facilitate selective variation of the detection area. The base station comprises a first transmitter and a first communication receiver. The first transmitter is configured to transmit a detection signal at a first frequency. The first communication receiver is configured to receive a first communication signal. The sensor is movable relative to the base station and is configured to selectively transmit the communication signal in response to the detection signal. The sensor comprises a detector and a first communication transmitter. The detector is configured to detect the detection signal. The first communication transmitter is configured to transmit the first communication signal at a second frequency. The first frequency is less than the second frequency. Movement of the sensor between the detection area and an area outside of the detection area affects detection of the detection signal.

In accordance with another embodiment, a detection system comprises a base station and a sensor. The base station defines a detection area and is configured to facilitate selective variation of the detection area. The base station comprises a first transmitter and a communication transceiver. The first transmitter is configured to transmit a detection signal at a first frequency. The communication transceiver is configured to transmit a first communication signal at a second frequency and to receive a second communication signal. The first frequency is less than the second frequency. The sensor is movable relative to the base station. The sensor comprises a detector and a sensor transceiver. The detector is configured to detect the detection signal. The sensor transceiver is configured to transmit the second communication signal at the second frequency and receive the first communication signal. The second communication signal is selectively transmitted in response to each of the detection signal and the first communication signal. Movement of the sensor between the detection area and an area outside of the detection area affects detection of the detection signal and receipt of the first communication signal.

In accordance with yet another embodiment, a method for detection comprises transmitting a first detection signal from a base station at a first frequency. The method further comprises moving a sensor relative to the base station, and defining a first detection area that is selectively variable. The method further comprises receiving the first detection signal at the sensor if the sensor is within the first detection area. The method further comprises selectively transmitting a communication signal from the sensor at a second frequency in response to the first detection signal. The first frequency is less than the second frequency.

In accordance with yet another embodiment, a proximity control system for an apparatus comprises an electronic device, a base station, and a sensor. The electronic device is associated with the apparatus. The base station is coupled with the apparatus and is operably coupled with the control device. The base station defines a first detection area and is configured to transmit a detection signal at a first frequency and is further configured to facilitate selective variation of the first detection area. The sensor is configured for selective association with an operator of the apparatus. The sensor is configured to detect the first detection signal and transmit a communication signal at a second frequency in response to the detection signal. Movement of the sensor between the first detection area and an area outside of the first detection area affects detection of the detection signal and wherein the first frequency is less than the second frequency. The base station is configured to actuate the electronic device in response to the communication signal from the sensor.

BRIEF DESCRIPTION OF THE DRAWINGS

The specification concludes with claims. To assist in the understanding of those claims, the following description is provided along with the accompanying drawings in which:

DETAILED DESCRIPTION

Specific examples of a detection system are described in detail in connection with the illustrations in FIGS. 1-14. Although a number of specific examples are illustrated and discussed, these specific examples do not provide an exhaustive list of the only examples possible. The examples provided and discussed, including any specific configuration of portions included in those examples, are presented to assist in the understanding of the systems and methods that are disclosed and claimed.

Figure 1:
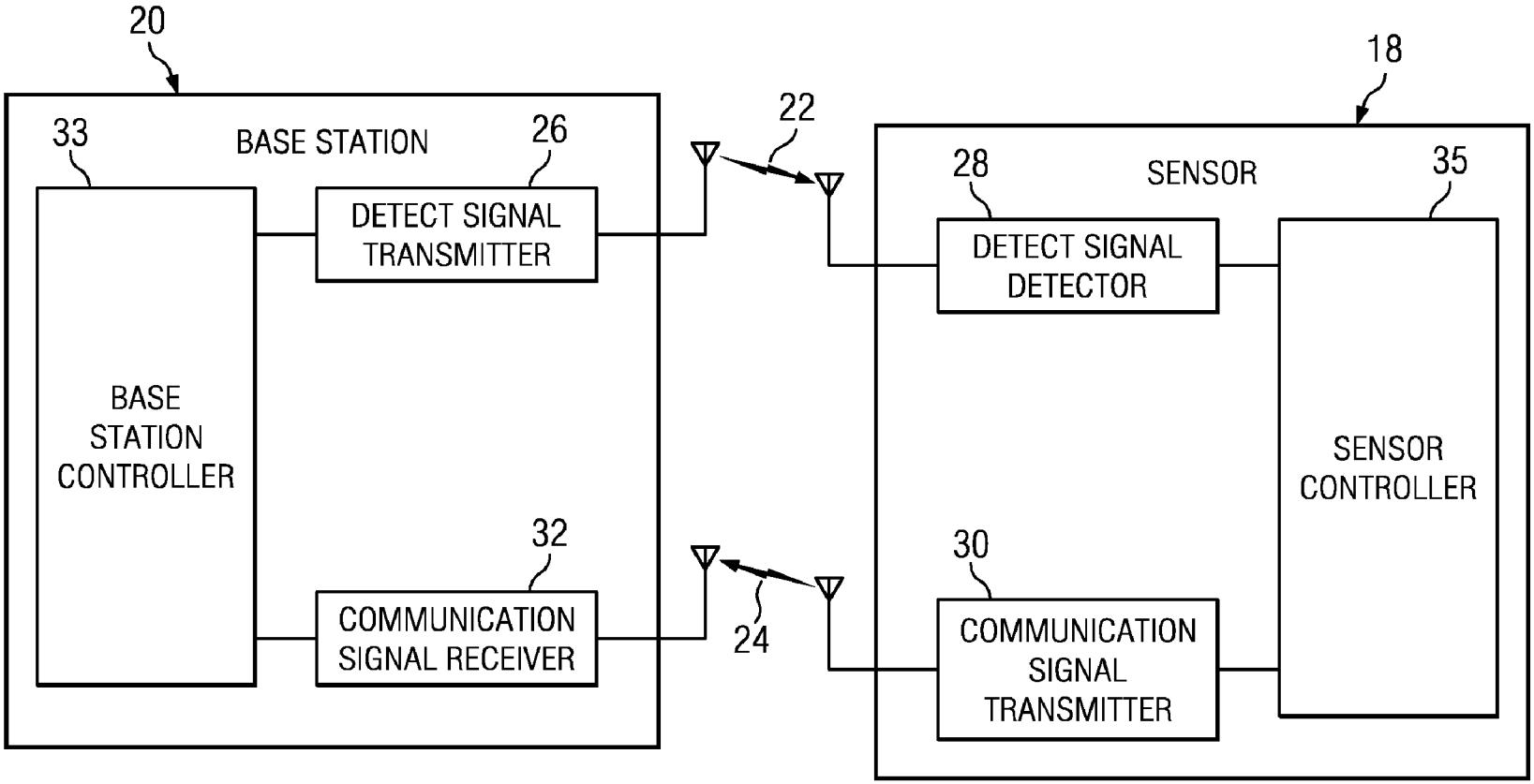
FIG. 1 is a schematic view depicting a base station and a sensor.

As illustrated in FIG. 1, a proximity detection system can include a sensor 18 and a base station 20. The base station 20 can be configured to transmit a detection signal 22 to the sensor 18. The sensor 18 can be configured to transmit a communication signal 24 back to the base station 20. In the example shown, the base station 20 and the sensor 18 can be implemented as a radio frequency identification (RFID) base station and an RFID tag, respectively. As illustrated in FIG. 1, the base station 20 can include a detection signal transmitter 26 that is configured to transmit the detection signal 22. The sensor 18 can include a corresponding detection signal detector 28 that is configured to receive the detection signal 22. The sensor 18 can also include a communication signal transmitter 30 that is configured to transmit the communication signal 24. The base station 20 can also include a corresponding communication signal receiver 32 that is configured to receive the communication signal 24. It should be noted that the communication signal 24 can be bidirectional to enable two-way communication between the base station 20 and the sensor 18. Two-way communication using the communication signal 24 can be desirable in environments where the detection signal 22 is subject to blockage or interference.

The base station 20 can include a base station controller 33 coupled with the detection signal transmitter 26 and the communication signal receiver 32. The sensor 18 can include a sensor controller 35 coupled with the detection signal detector 28 and the communication transmitter 30. The base station controller 33 and the sensor controller 35 can facilitate transmission of the respective detection signal 22 and communication signal 24 and can control certain variables such as signal duration, signal frequency, or signal modulation, for example. The base station controller 33 and the sensor controller 35 can also facilitate reception of the communication signal 24 and the detection signal 22 such as through signal processing. In one possible implementation, the base station controller 33 and the sensor controller 35 can each include a digital signal processor (not shown).

The detection signal transmitter 26, detection signal detector 28, communication signal transmitter 30, and communication signal receiver 32 can include any of a variety of suitable antennas to detect or receive the detection signal 22 and the communication signal 24. For example, the detection signal transmitter 26 and communication signal transmitter 30 can each include a radio frequency transmit coil. The detection signal detector 28 and the communication signal receiver 32 can accordingly include RF antennas. The radiation patterns of the detection signal transmitter 26 and the communication signal transmitter 30 shown in FIGS. 2-7 and 9-14 can be either substantially round or substantially elliptical. However, any of a variety of suitable alternative antennas can be selected to achieve a particular desired radiation pattern. For example, a detection signal transmitter can include a directional antenna or another suitable antenna for a specific application.

Figure 2:
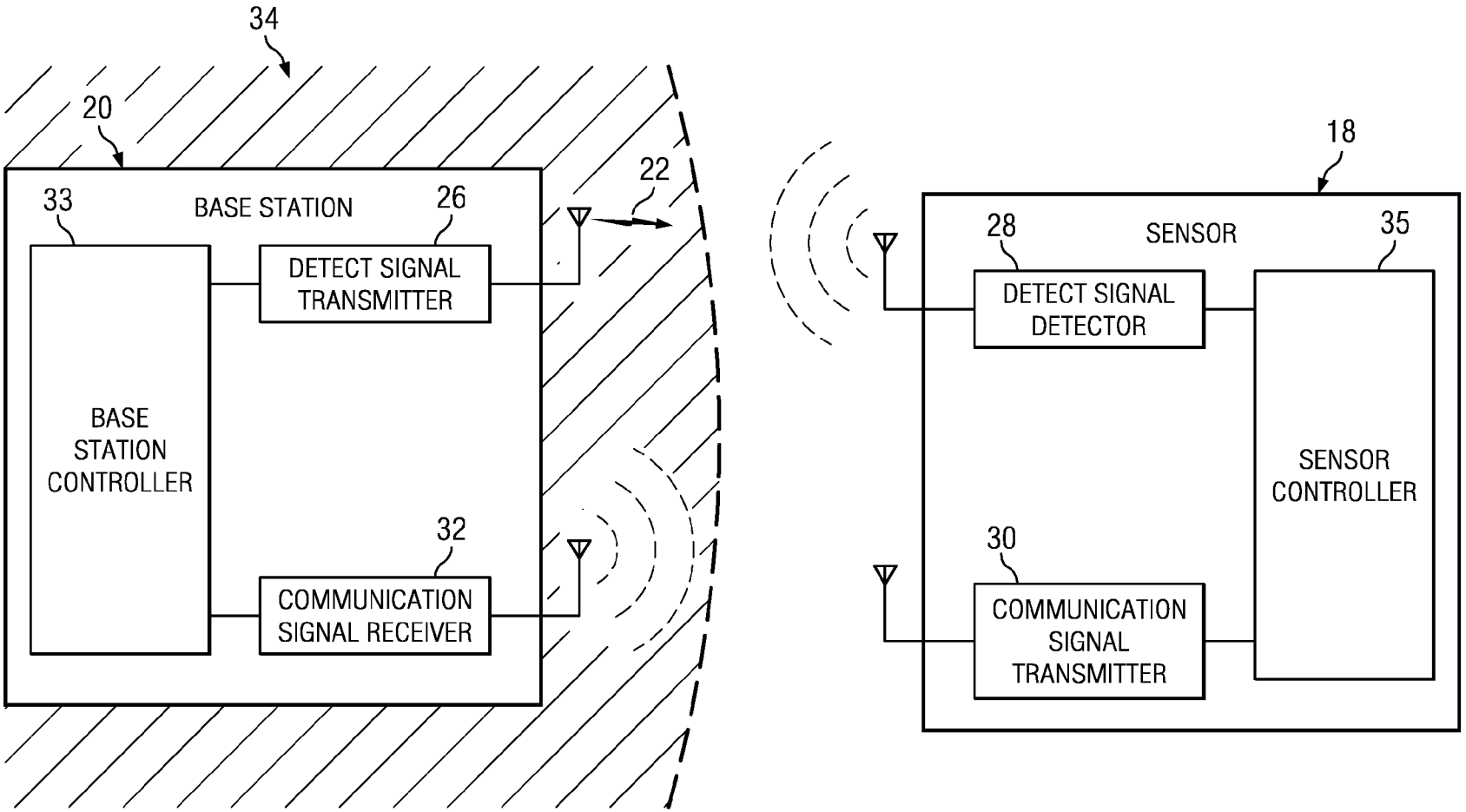
FIG. 2 is a schematic view depicting the base station and sensor of FIG. 1 and specifically shows a detection signal transmitter transmitting a detection signal and a sensor outside of a detection area.
Figure 3:
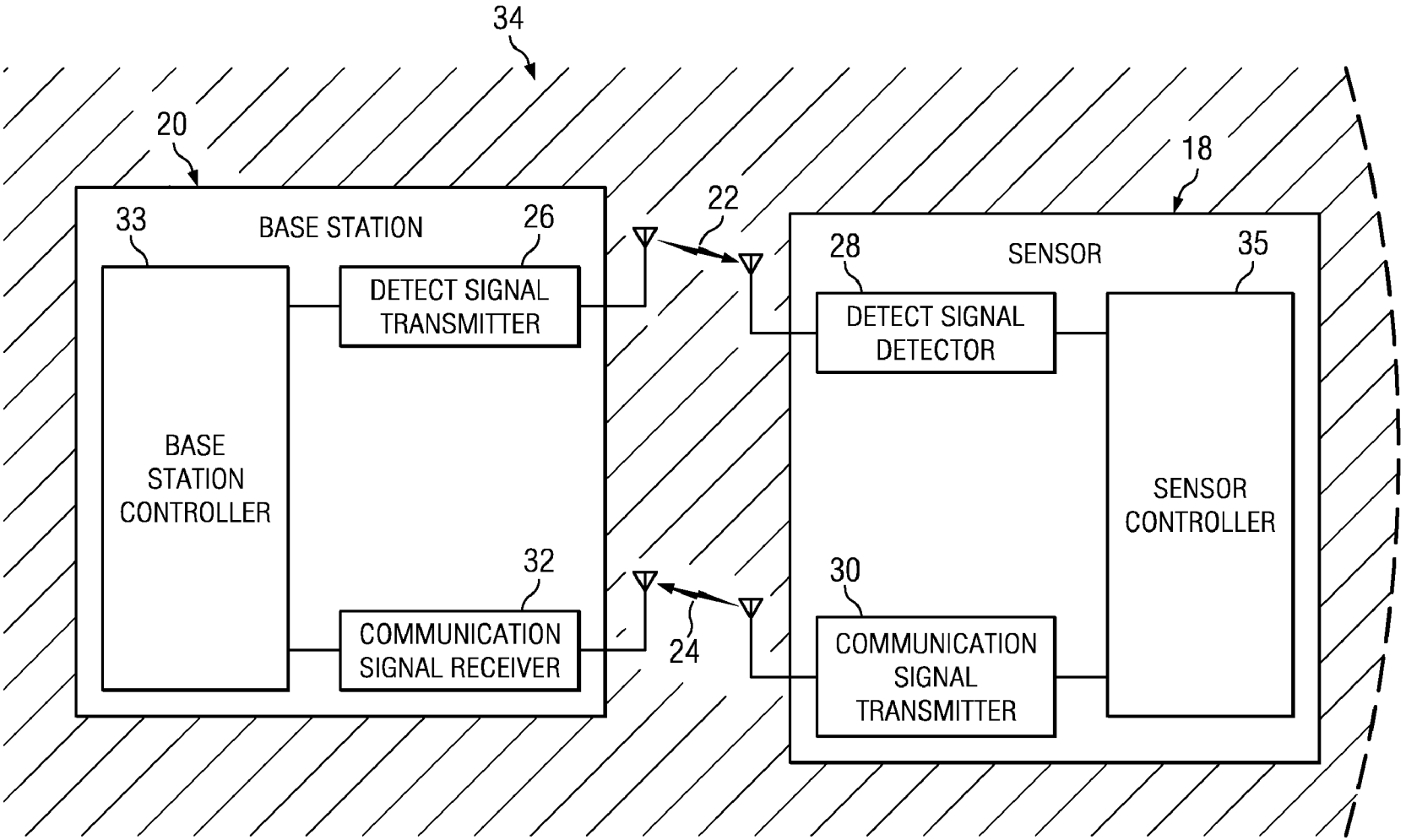
FIG. 3 is a schematic view depicting the base station and sensor of FIG. 1 and specifically shows a sensor within the detection area and a communication signal transmitter transmitting a communication signal.

As described in further detail below, the sensor 18 can be moved relative to the base station 20. Movement of the sensor 18 can affect detection of the detection signal 22 by the sensor 18. For example, the detection signal 22 can be attenuated as it propagates from the base station 20. If the sensor 18 is too far away from the base station 20, the detection signal detector 28 may not receive the detection signal 22 such that the sensor 18 is unable to detect the detection signal 22. In one example, attenuation of the detection signal 22 can assist in defining a detection area 34, as illustrated in FIGS. 2 and 3. In such an implementation, movement of the sensor 18 between the detection area 34 and an area outside of the detection area 34 can affect detection of the detection signal 22 and can be the difference between detection and a failure to detect. For example, when the sensor 18 is outside of the detection area 34, as illustrated in FIG. 2, the detection signal 22 may be too weak to be received by the detection signal detector 28 and thus undetectable by the sensor 18. However, when the sensor 18 is within the detection area 34, as illustrated in FIG. 3, the detection signal 22 can be strong enough to be received by the detection signal detector 28 and thus detectable by the sensor 18.

The sensor 18 can be configured to selectively transmit the communication signal 24 to the base station 20 in response to the detection signal 22. In one example, if the detection signal 22 is not detected by the sensor 18, then the sensor 18 does not transmit the communication signal 24 back to the base station 20. However, if the sensor 18 detects the detection signal 22, the sensor 18 can transmit the communication signal 24 back to the base station 20.

Referring again to FIGS. 2 and 3, the communication signal 24 can be selectively transmitted by the sensor 18 depending upon whether the sensor 18 is within the detection area 34 or within an area outside of the detection area 34. For example, as illustrated in FIG. 2, if the sensor 18 is outside of the detection area 34, the communication signal 24 may not be transmitted to the base station 20. However, if the sensor 18 moves within the detection area 34, as illustrated in FIG. 3, the communication signal 24 can be transmitted to the base station 20.

Figure 4:
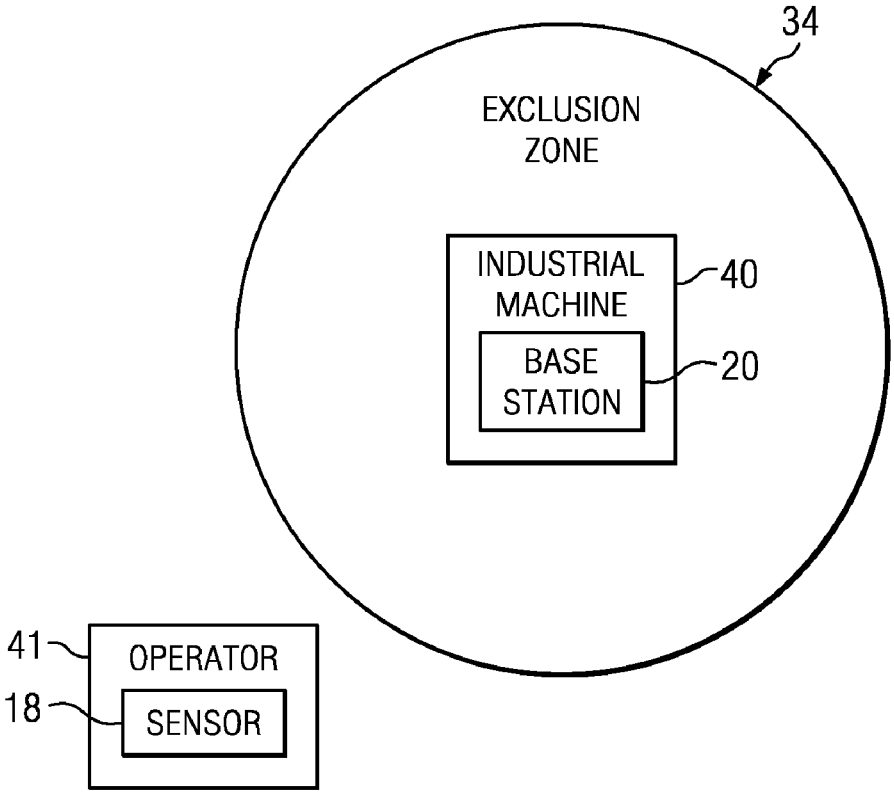
FIG. 4 is a schematic view depicting a base station coupled with an industrial machine and a sensor coupled with an operator wherein the operator is outside of an exclusion zone.
Figure 5:
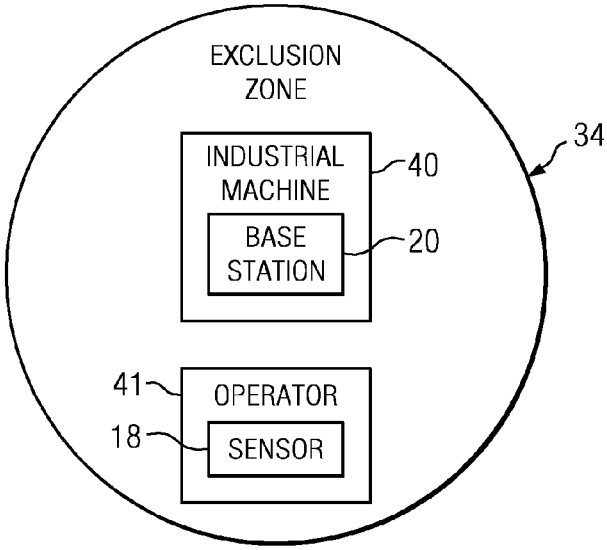
FIG. 5 is a schematic view similar to FIG. 4 but with the operator within the exclusion zone.

In one specific example, as illustrated in FIGS. 4-5, the sensor 18 and the base station 20 can be used as a proximity control system for an industrial machine 40, such as a rotating cutter wheel, a welder, or any of a variety of other industrial machines. The base station 20 can be coupled with the industrial machine 40 as part of an interlock system. The sensor 18 can be associated with an operator 41. The detection area 34 of the base station 20 can be used to define an exclusion zone for the operator 41.

During operation of the industrial machine 40, the base station 20 can transmit the detection signal 22 to determine whether the operator 41 is within the exclusion zone. If the operator 41 remains outside of the exclusion zone, as illustrated in FIG. 4, the sensor 18 does not transmit the communication signal 24 to the base station 18 and the industrial machine 40 is free to operate. However, once the operator 41 moves into the exclusion zone, as illustrated in FIG. 5, the communication signal 24 is transmitted to the base station 18 and the base station 20 can facilitate interruption of power to the industrial machine 40 to cease operation of the industrial machine 40.

Figure 6:
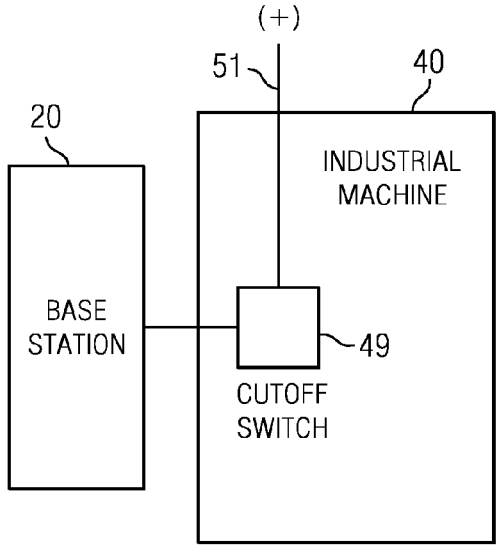
FIG. 6 is a schematic view depicting a base station coupled with a cut-off switch of an industrial machine according to one embodiment.

In one example, as illustrated in FIG. 6, the industrial machine 40 can include a cut-off switch 49 that is configured to interrupt power to or otherwise cease operation of the industrial machine 40. The cut-off switch 49 can be in electrical communication with power source 51 for the industrial machine 40. The base station 20 can be operably coupled with the cut-off switch 49 and configured to actuate the cut-off switch 49. When the communication signal 24 is received by the base station 20, the base station 20 can actuate the cut-off switch 49 to disconnect the power source 51 from the industrial machine 40 to cease operation of the industrial machine 40. The base station 20 can selectively interrupt operation of the industrial machine 40 in any of a variety of suitable alternative manners. It will also be appreciated that the base station 20 can additionally or alternatively perform any of a variety of other operations when the operator 41 enters the exclusion zone. In one example, the base station 20 can facilitate operation of an audible or visual alarm.

In another possible configuration, the base station 20 can be attached directly to the industrial machine 40. However, in other examples, the base station 20 can rest on an adjacent floor, can be attached to an adjacent wall, can be attached to the operator's chair, or can otherwise be associated with a base station in any of a variety of suitable alternative arrangements. In one possible example construction, the sensor 18 can be attached to an operator such as through attachment to the operator's clothing. In another, the sensor 18 can be additionally or alternatively integrated into a hand-held control device for the industrial machine 40. In such an arrangement, if the hand-held control device remains outside of the detection area 34, the operator 41 is free to control the industrial machine with the control device. However, once the control device enters the detection area 34, the base station 20 can disable further control of the industrial machine 40 from the hand-held control device while simultaneously facilitating interruption of power to the industrial machine 40.

It will be appreciated that the sensor 18 and the base station 20 can be used in any of a variety of applications. In one possible application, the sensor 18 and the base station 20 can be used in a retail sales environment to provide a notification of theft of merchandise. In such an application, the base station 20 can be coupled with an alarm system, such as an audible alarm, and a sensor (for example, the sensor 18) can be associated with each piece of merchandise within the store. The base station 20 can be located at a point of entrance to or egress from the store such that the detection area 34 of the base station 20 defines a theft zone outside of the store. The base station 20 can transmit the detection signal 22 to determine whether any of the merchandise is within the defined theft zone. If a piece of merchandise incorporating a sensor enters the theft zone, the communication signal 24 can be transmitted from the sensor (for example, the sensor 18) to the base station 20 and the base station 20 can actuate the alarm.

In another possible example, the sensor 18 and the base station 20 can be used for patient monitoring at a health care facility. In this example, the base station 20 can be coupled with an alarm system, such as a visual or audible alarm, and a sensor (for example, the sensor 18) can be associated with each occupant of the health care facility. The base station 20 can be located at each point of entrance to or egress from the health care facility such that the detection area 34 of the base station 20 defines an unauthorized exit zone outside of the health care facility. The base station 20 can transmit the detection signal 22 to determine whether any occupants are within the unauthorized exit zone. If an occupant wearing a sensor enters the unauthorized exit zone, the communication signal 24 can be transmitted from the sensor to the base station 20, and the base station 20 can facilitate operation of an alarm and may close or otherwise secure nearby doors.

The base station 20 can be configured to vary the size of the detection area 34. Power of the detection signal 22 can be changed to vary the size of the detection area 34. For example, the signal power of the detection signal 22 can be reduced or increased to respectively shrink or enlarge the detection area 34. In one embodiment, the signal power of the detection signal 22 can be selectively varied to facilitate selective sizing of the detection area 34.

Figure 7:
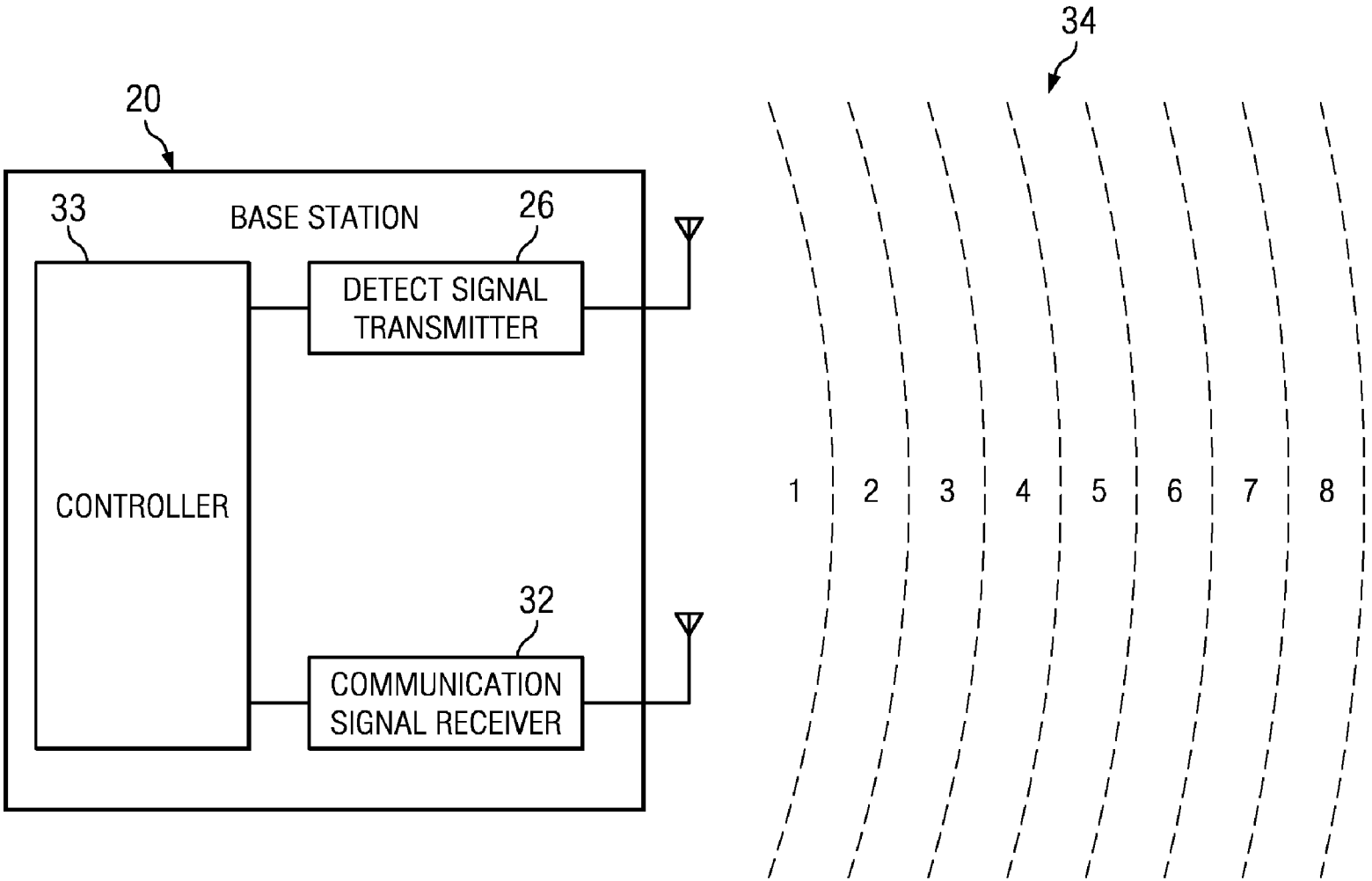
FIG. 7 is a schematic view depicting a sensor defining different detection areas.

As illustrated in FIG. 7, the size of the detection area 34 can be selectively varied between eight different sizes. In such an example, the base station 20 can include an 8-position rotary switch (not shown) that can facilitate incremental variation of the signal power of the detection signal 22. The 8-position rotary switch can be actuated to facilitate selection between the eight different sizes of the detection area 34. Selective variation between different sizes of the detection area 34 can allow for customization of the detection area 34 without requiring signification reconfiguration of the base station 20 (for example, exchanging of components or rewiring of electrical circuits, among others).

In the example of FIGS. 4 and 5, if the exclusion zone for the industrial machine 40 is too small such that it permits the operator 41 to move too close to the industrial machine 40 before power to the industrial machine 40 is interrupted, the size of the detection area 34 can be manually increased through actuation of the 8-position rotary switch. The detection area 34 can be varied between any of a number of sizes. It will also be appreciated that any of a variety of suitable alternative selectors can facilitate manual selection of the size of the detection area 34 such as, for example, a two position switch. In an alternative embodiment, the controller 33 of the base station 20 can be configured to change the size of the detection area 34 at the direction of a user. In such an embodiment, a user can couple a communication device, such as a computer, with the controller to selectively change the size of the detection area with the communication device.

Varying the signal power of the detection signal 22 can be achieved in any of a variety of manners. In various examples, the voltage of the detection signal transmitter 26 can be varied to vary the signal power of the detection signal 22, the current from the detection signal transmitter 26 can be varied to vary the signal power of the detection signal 22, the base station 20 can control a duty cycle of the detection signal 22 to vary the signal power of the detection signal 22, or the base station 20 can modulate a pulse width of the detection signal 22 to vary the signal power of the detection signal 22. Additionally or alternatively, if the detection signal transmitter 26 is coupled with a capacitor in a resonant tank configuration, then the base station 20 can control a frequency of the detection signal 22 to vary the signal power of the detection signal 22.

In another example, the size of the detection area 34 can be automatically and continuously varied between a minimum size and a maximum size (for example, a continuous range sweep). By identifying the particular size of the detection area 34 that induces transmission of the communication signal 24 from the sensor 18, the distance of the sensor 18 from the base station 20 can be determined. In this example, the location and size of the detection transmitter 26 can affect the size of the detection area 34. Therefore, the size and location of the detection signal transmitter 26 may be selected during manufacture to achieve a desired detection area 34.

In another example, the sensor 18 can be configured to vary the sensitivity of the detection signal receiver 28. Varying the sensitivity of the detection signal receiver 28 can change the proximity to the detection area 34 that the sensor 18 must achieve to detect the detection signal 22 at the detection signal receiver 26.

Figure 8:
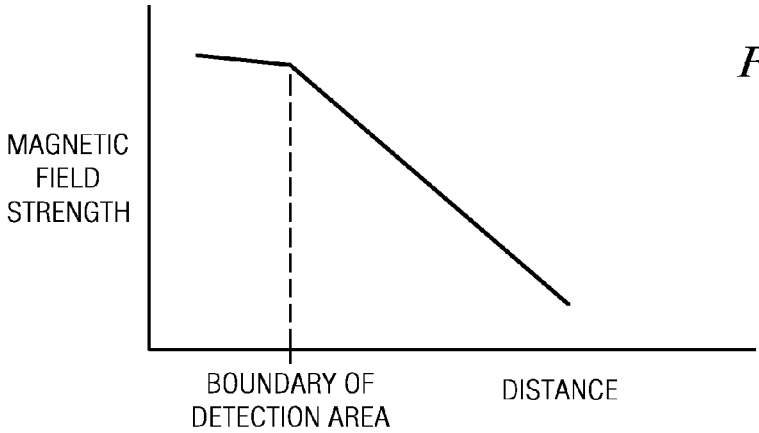
FIG. 8 is a graph of a relationship between magnetic field strength and distance for a detection signal.

In still another example, the detection signal 22 can include a radio frequency (RF) signal having a frequency between about 100 kHz and about 150 kHz (conventionally called "low frequency" or LF). Such an RF signal may not be as easily attenuated or reflected by nearby objects (non-conductive and conductive objects) or environmental effects (such as atmospheric moisture) as can RF signals with a higher frequency. Such an RF signal may also employ magnetic field (inductive) coupling in the near field (for example, less than a distance of wavelength divided by 2*pi, but greater than a diameter of the detection signal transmitter 26) which can provide a field strength that drops off at between about 40 dB to about 60 dB per decade, as illustrated in FIG. 8. For example, at a frequency of about 134.2 KHz, and a detection signal transmitter diameter of about 0.5 meters, the field strength can decay from about 0.5 meters to about 350 meters. This magnetic field coupling in the near field can provide a well defined (high resolution) range boundary due to the steep field strength slope at the edge of the range boundary which can provide good resolution performance.

In one embodiment, the communication signal 24 can comprise an RF signal having a frequency between about 902 MHz and about 928 MHz (conventionally called "ultra high frequency" or UHF). In another embodiment, the communication signal 24 can comprise an RF signal having a frequency between about 27 MHz and about 6 GHz (conventionally called "very high frequency" or VHF).

Integrity of the sensor 18 and the base station 20 can be monitored in any of a variety of suitable manners. For example, the sensor 18 can be configured to test both the detection signal receiver 28 and the communication signal transmitter 30 for an open circuit or short circuit. In another example, the base station 20 can be configured to test both the detection signal transmitter 26 and the communication signal receiver 32 for an open circuit or short circuit. In another example, a unique identifier, such as a serial number, can be modulated onto the detection signal 22. If the serial number modulated onto the detection signal 22 matches the serial number of the sensor 18, the sensor 18 can respond by transmitting the communication signal 24. In another example, the sensor 18 and base station 20 can be configured to repeat transmission of the respective detection signal 22 and communication signal 24. In yet another example, encryption or rolling code algorithms can be modulated onto the detection signal 22 and the communication signal 24.

Figure 9:
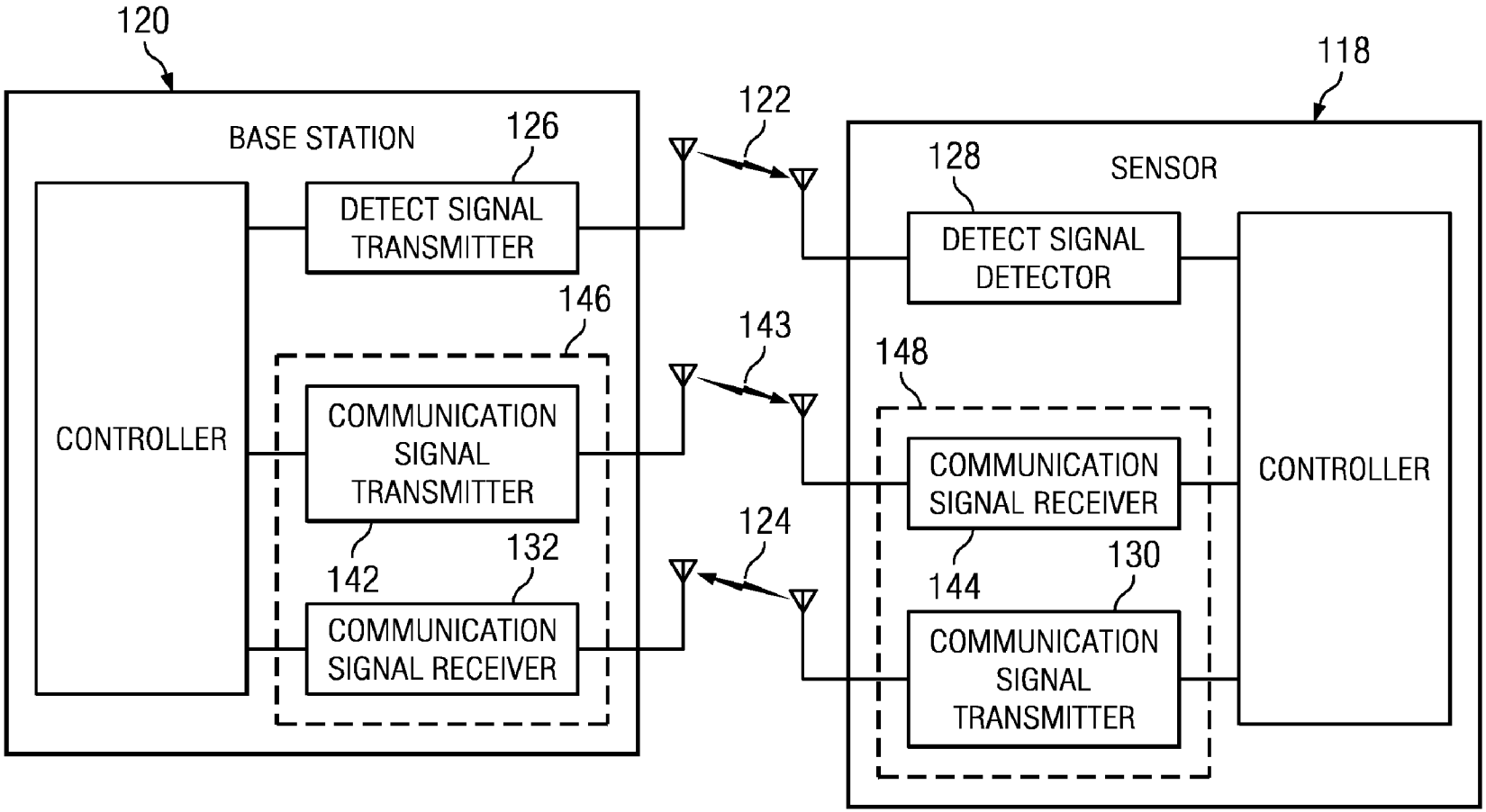
FIG. 9 is a schematic view of a base station and a sensor according to another embodiment.

FIG. 9 illustrates another exemplary sensor 118 and base station 120. The sensor 118 and base station 120 can be similar to, or the same in many respects to the sensor 18 and base station 20 shown in FIGS. 2 and 3. For example, the sensor 118 can include a detection signal detector 128 that is configured to receive a detection signal 122 and can include a communication signal transmitter 130 that is configured to transmit a communication signal 124. The base station 120 can include a detection signal transmitter 126 that is configured to transmit the detection signal 122 and can include a communication signal receiver 132 that is configured to receive the communication signal 124. The sensor 118 however can include a communication signal receiver 144 and the base station 120 can include a communication signal transmitter 142. The communication signal transmitter 142 can be configured to transmit a communication signal 143 and the communication signal receiver 144 can be configured to receive the communication signal 143. The communication signal transmitter 142 and the communication signal receiver 132 can comprise a base station transceiver 146. The communication signal transmitter 130 and the communication signal receiver 144 can comprise a sensor transceiver 148.

The base station transceiver 146 and the sensor transceiver 148 can facilitate bidirectional communication between the base station 120 and the sensor 118. In one embodiment, bidirectional communication between the sensor 118 and the base station 120 can facilitate execution of a synchronization routine. In such an embodiment, the base station transceiver 146 can transmit the communication signal 143 to the sensor transceiver 148 and the sensor transceiver 148 can respond to the communication signal 143 by transmitting communication signal 124 back to the base station 120. Receipt of the communication signal 124 by the base station 120 can synchronize a future transmission of the communication signal 124 that may be initiated by detection of the detection signal 122. In another embodiment, bidirectional communication between the sensor 118 and the base station 120 can facilitate execution of a configuration routine. In such an embodiment, the base station transceiver 146 can transmit a detect-initiate command to the sensor 118. If the sensor transceiver 148 responds with an acknowledgment, the base station transceiver 146 can transmit configuration commands such as address settings, baud settings, or the like. In yet another embodiment, bidirectional communication between the sensor 118 and the base station 120 can facilitate execution of a securitization routine. In such an embodiment, the base station transceiver 146 can transmit an encrypted message to the sensor 118. If the sensor transceiver 148 responds with the proper response to the encrypted message, the identity of the sensor 118 can be verified and future transmissions from the sensor 118 can be trusted.

In yet another embodiment, bidirectional communication between the sensor 118 and the base station 120 can facilitate execution of a failure safety routine. In such an embodiment, a redundant detection area can be defined by the communication signal 143 in a similar manner as described above with the detection signal 22 and the detection area 34. If the communication receiver 144 of the sensor 118 receives the communication signal 143, the sensor 118 can respond by transmitting the communication signal 124 back to the base station 120. If the primary means of detection of the sensor 118 is interrupted (e.g., due to detection signal transmitter 22 failure), the failure safety routine can be executed to ensure proper detection of the sensor 118 by the base station 120.

In one possible implementation, the sensor 118 and the base station 120 can be included within a network of other sensors and base stations. In this case, the base station transceiver 146 and sensor transceiver 148 can facilitate duplex communication between the sensor 120 and the other sensors, between the base station 120 and the other base stations, and between the sensors and the base stations.

Figure 10:
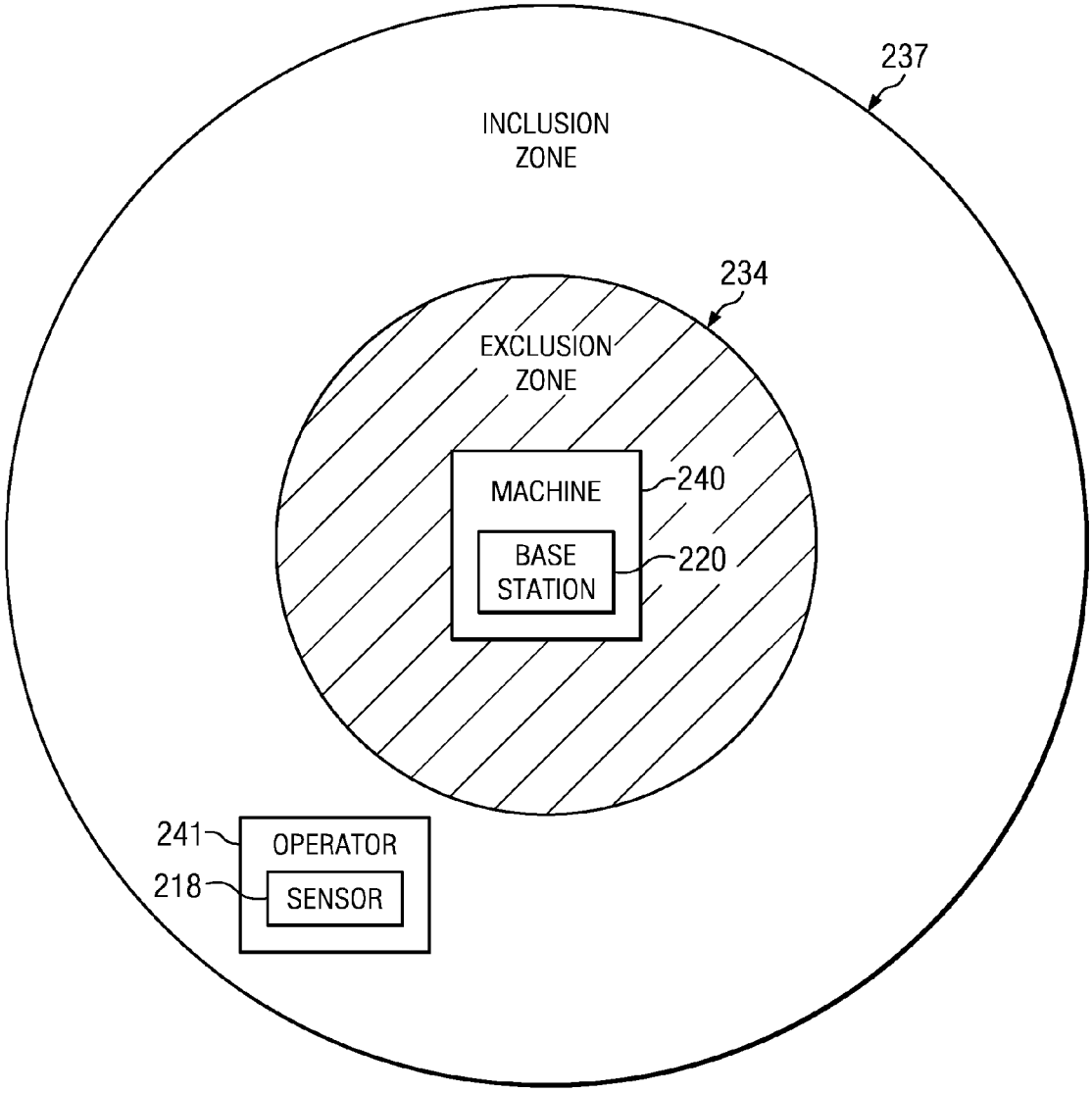
FIG. 10 is a schematic view depicting a base station coupled with an industrial machine and a sensor coupled with an operator in accordance with another embodiment, wherein the operator is outside of an exclusion zone and within an inclusion zone.
Figure 11:
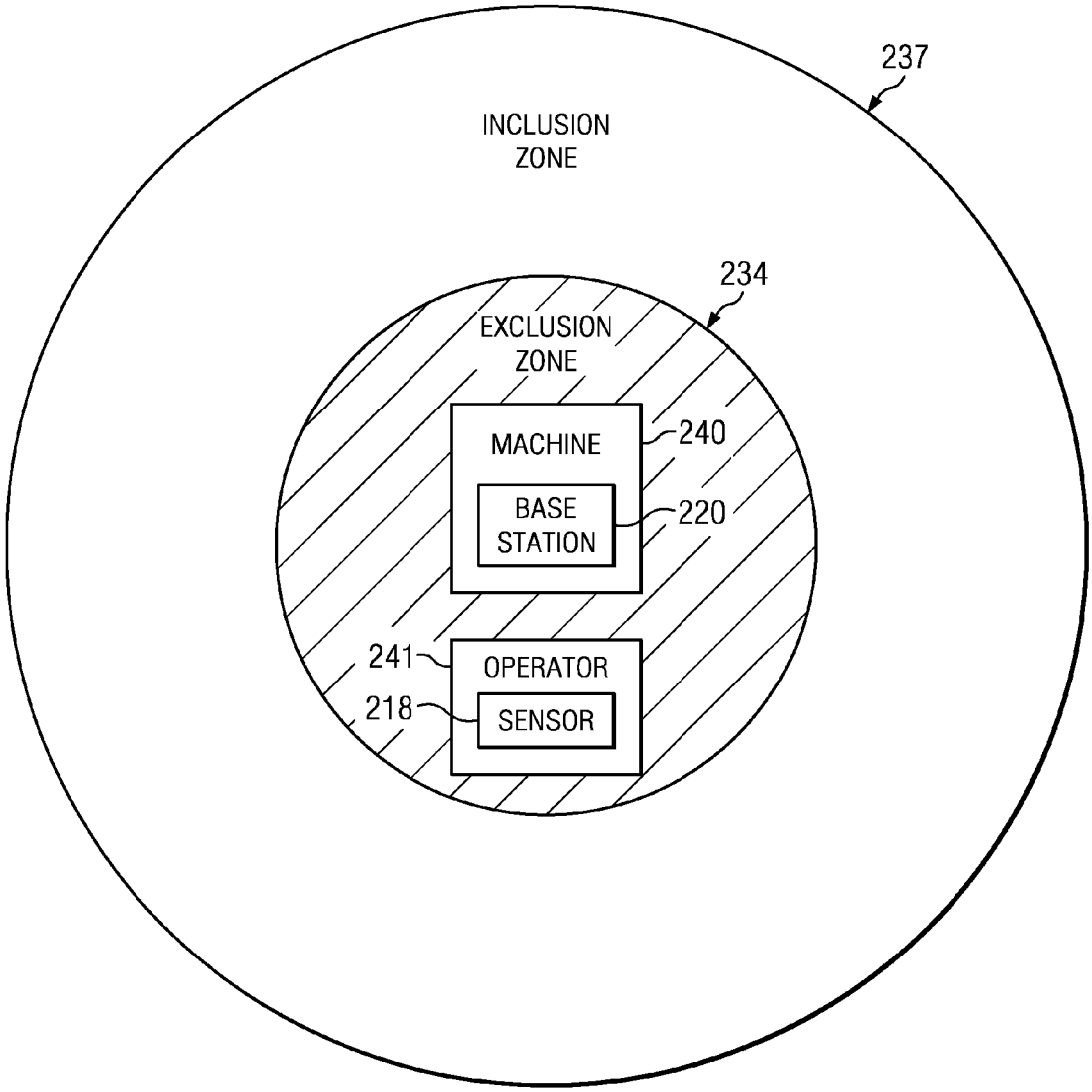
FIG. 11 is a schematic view similar to FIG. 9, but with the operator within the exclusion zone and outside of the inclusion zone.

Any of a variety of suitable detection area shapes and sizes can be defined by a base station. It will also be appreciated that a base station can be configured to achieve any of a variety of proximity control schemes. For example, as illustrated in FIGS. 10 and 11, a base station 220 can be configured to define an exclusion zone and an inclusion zone for an industrial machine 240. The base station 220 can be coupled with the industrial machine 240 and a sensor 218 can be associated with an operator 241. The base station 220 can alternate between transmission of a low-power detection signal and a high-power detection signal. The low-power detection signal can define a low-power detection area 234 that defines the exclusion zone. The high-power detection signal can define a high-power detection area 237 that defines the inclusion zone. During operation of the industrial machine 240, the base station 220 can alternate transmission of the low-power detection signal and the high-power detection signal to determine whether the operator 241 is within the exclusion zone or the inclusion zone. If the operator is within the inclusion zone, the sensor 218 can transmit the communication signal, such as the communication signal 24, to the base station 218 in response to the high-power detection signal and the industrial machine 240 can be free to operate. In addition, the operator is free to control the industrial machine 240 such as with a hand-held remote. If the operator 241 moves into the exclusion zone, the sensor 218 can transmit the communication signal (e.g., 24) to the base station 220 in response to the low-power detection signal and the base station 220 can facilitate interruption of power to the industrial machine 240 to cease operation of the industrial machine 240. The modes of operation can also be reversed.

Figure 12:
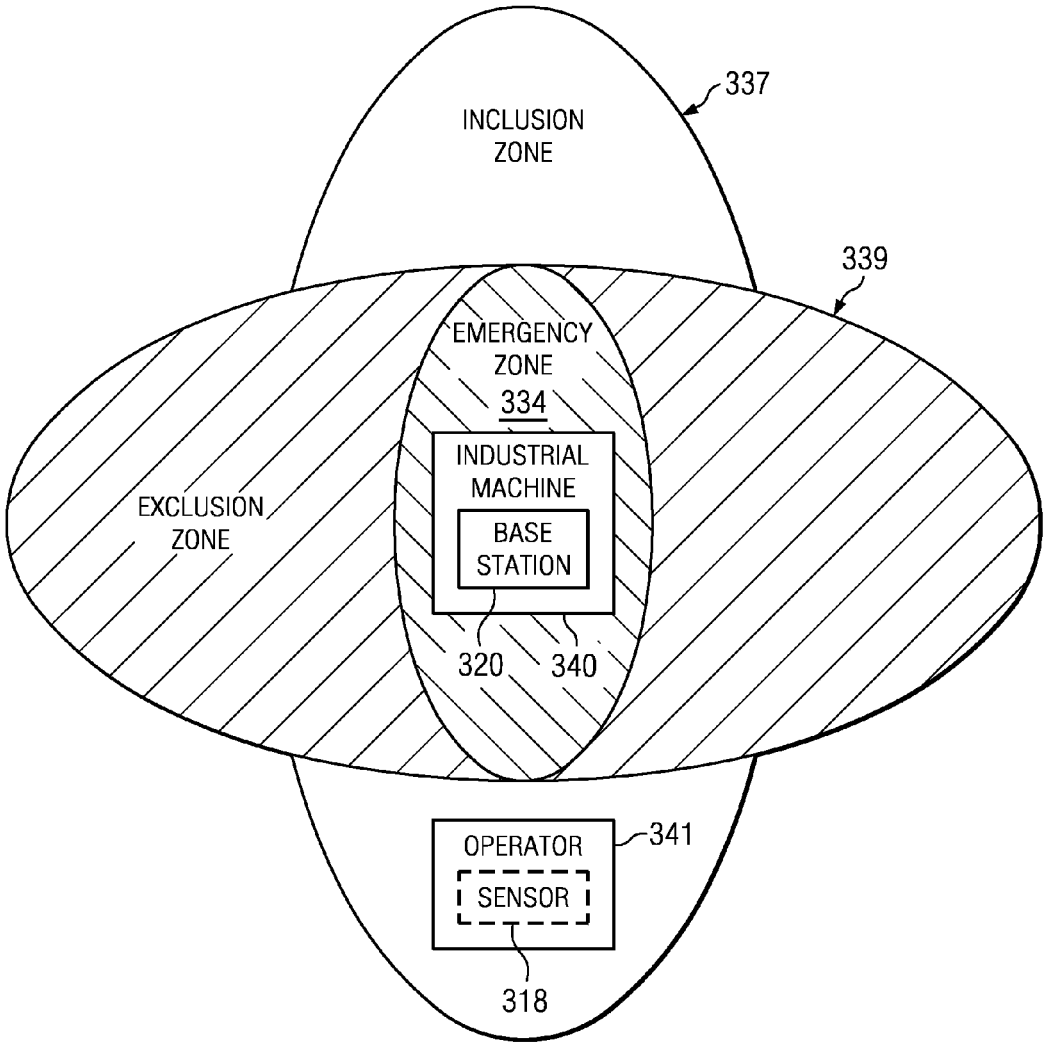
FIG. 12 is a schematic view depicting a base station coupled with an industrial machine and a sensor coupled with an operator in accordance with another embodiment, wherein the operator is within an inclusion zone and outside of each of an exclusion zone and an emergency zone.
Figure 13:
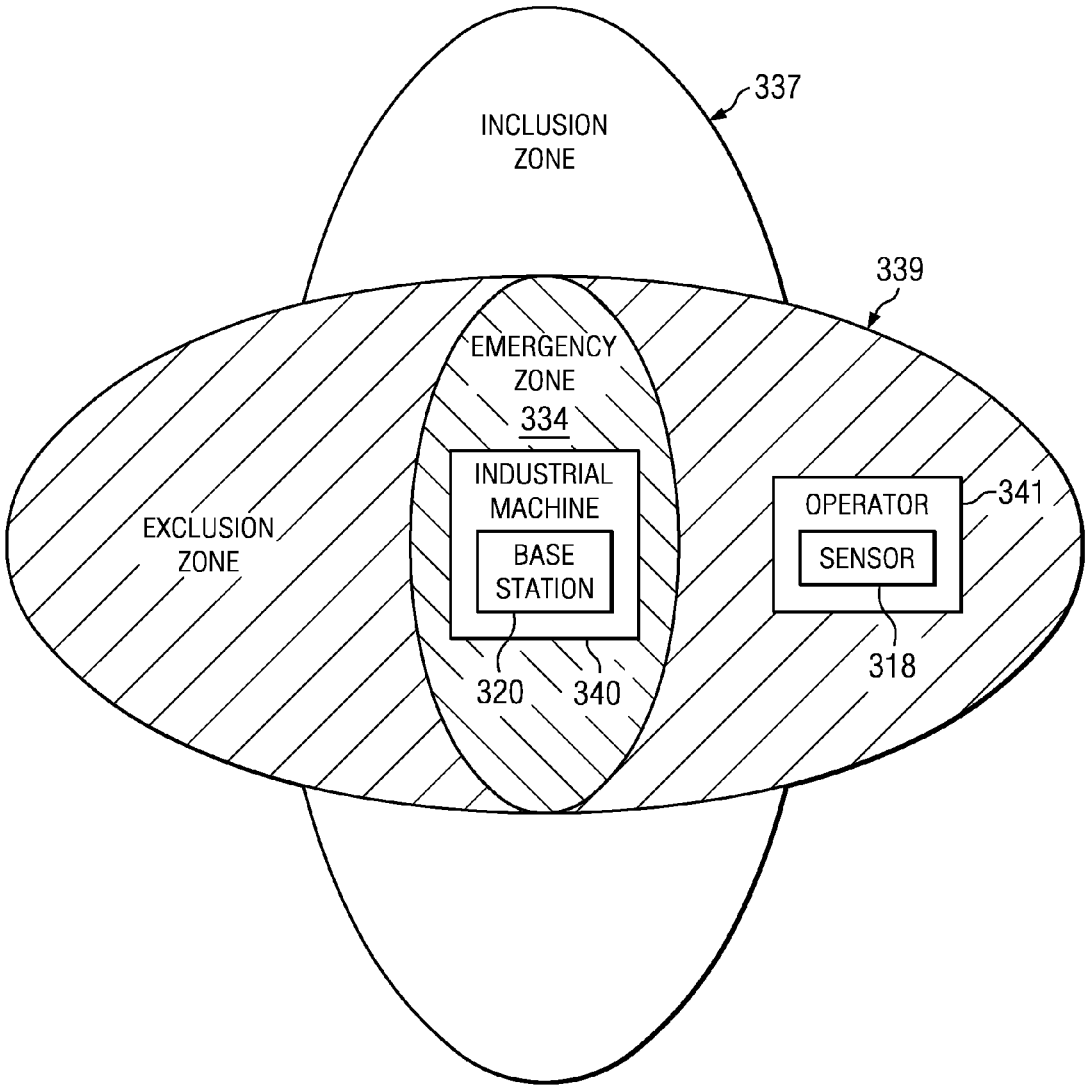
FIG. 13 is a schematic view similar to FIG. 12, but with the operator within the exclusion zone and outside of each of the inclusion zone and the emergency zone.
Figure 14:
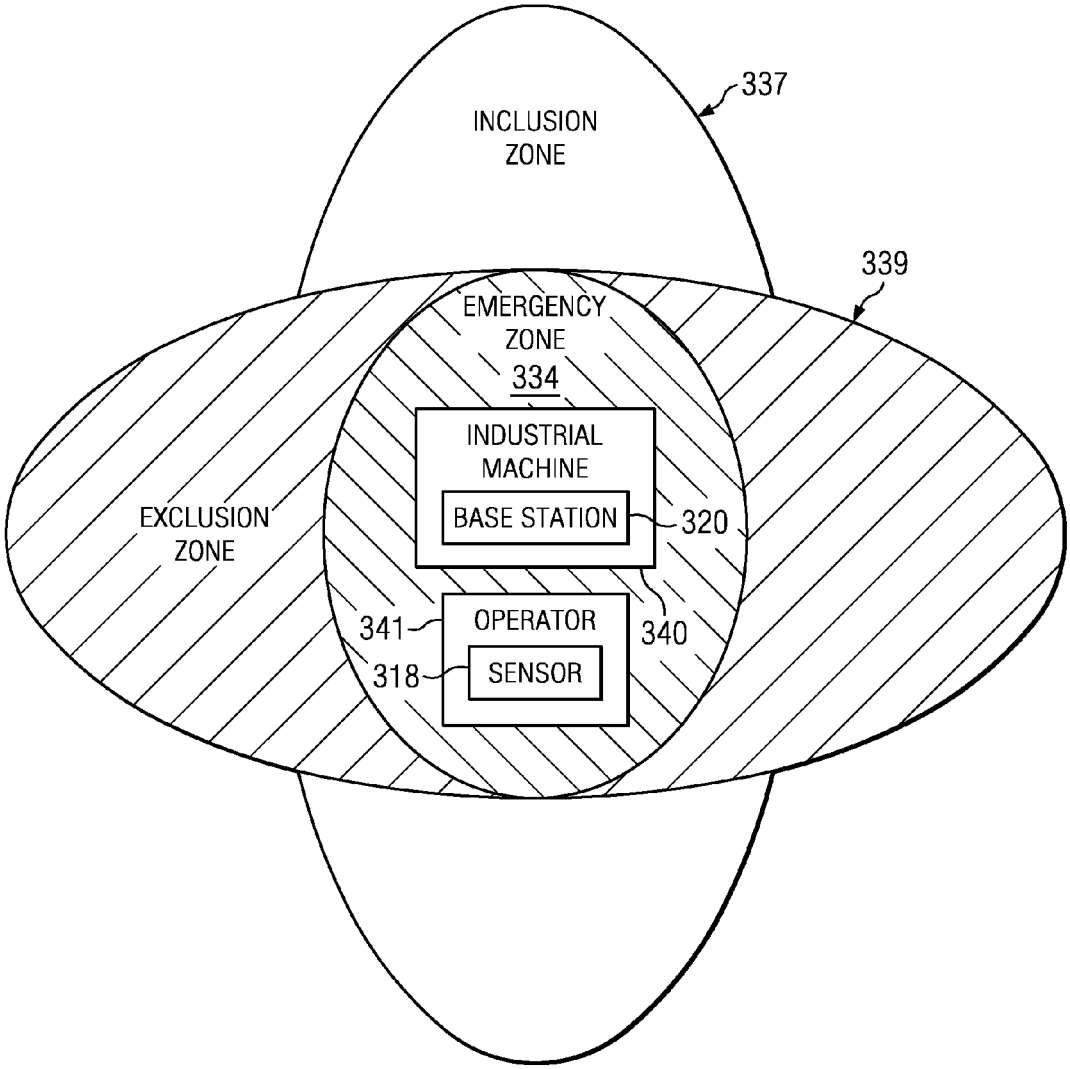
FIG. 14 is a schematic view similar to FIG. 12 but with the operator within the emergency zone and outside of each of the inclusion zone and the exclusion zone.

In another example, as illustrated in FIGS. 12-14, a base station 320 can be configured to define an emergency zone, an exclusion zone, and an inclusion zone for an industrial machine 340. The base station 320 can be coupled with the industrial machine 340 and a sensor 318 can be associated with an operator 341. The base station 320 can include a first detection signal transmitter and a second detection signal transmitter. The base station 320 can alternate between transmission of a low-power detection signal from the first detection signal transmitter, transmission of a high-power detection signal from the first detection signal transmitter, and transmission of a second detection signal from the second detection signal transmitter. The low-power detection signal can define a low-power detection area 334 that defines the emergency zone. The high-power detection signal can define a high-power detection area 337 that defines the inclusion zone.

The second detection signal can define a second detection area 339 that defines the exclusion zone. To achieve elliptical shapes for the low-power, high-power, and emergency detection areas 334, 337, 339, the first and second detection signal transmitters can comprise directional antennas. During operation of the industrial machine 340, the base station 320 can alternate transmission of the low-power detection signal, the high-power detection signal, and the second detection signal to determine whether the operator 341 is within the emergency zone, the exclusion zone, or the inclusion zone.

If the operator is within the inclusion zone, the sensor 318 transmits the communication signal (e.g., 24) to the base station 318 in response to the high-power detection signal and the industrial machine 340 is free to operate. In addition, the operator is free to control the industrial machine 340 such as with a hand-held remote. If the operator moves into the exclusion zone but outside of the emergency zone, the sensor 318 can transmit the communication signal to the base station 320 in response to the second detection signal and the base station 320 can facilitate interruption of power to the industrial machine 340 to cease operation of the industrial machine 340. If the operator moves into the emergency zone, the sensor 318 can transmit the communication signal to the base station 320 in response to the low-power detection signal and the base station 320 can facilitate interruption of power to the industrial machine 340 to cease operation of the industrial machine 340.

While various examples of a proximity detection system have been illustrated by the above description and have been described in detail with respect to FIGS. 1-14, these examples are neither intended to be exhaustive nor to limit the scope of the appended claims to such detail. Numerous modifications are possible and contemplated in light of the above information. Some of those modifications have been discussed and others will be understood by those skilled in the art.

What is claimed is:

1. A detection system comprising:

a base station defining a detection area and configured to facilitate selective variation of the detection area, the base station comprising:

a first transmitter configured to transmit a detection signal at a first frequency; and a first communication receiver configured to receive a first communication signal; and a sensor movable relative to the base station and configured to selectively transmit the communication signal in response to the detection signal, the sensor comprising:

a detector configured to detect the detection signal; and a first communication transmitter configured to transmit the first communication signal at a second frequency, the first frequency being less than the second frequency;

wherein movement of the sensor between the detection area and an area outside of the detection area affects detection of the detection signal.

2. The detection system of claim 1 wherein the detection signal comprises a radio frequency signal, the first frequency is between about 100 kHz and about 150 kHz, the first communication signal comprises a radio frequency signal, and the second frequency is between about 900 MHz and about 928 MHz.

3. The detection system of claim 1 wherein the detection signal comprises a radio frequency signal, the first frequency is between about 100 kHz and about 150 kHz, the first communication signal comprises a radio frequency signal, and the second frequency is between about 30 MHz and about 300 MHz.

4. The detection system of claim 1 wherein the base station is configured to vary a signal power of the detection signal in order to vary the detection area.

5. The detection system of claim 1 wherein the base station further comprises a second communication transmitter configured to transmit a second communication signal and the sensor further comprises a second communication receiver configured to receive the second communication signal.

6. The detection system of claim 1 wherein the first communication transmitter, the first communication receiver, the second communication transmitter, and the second communication receiver facilitate bidirectional communication between the base station and the sensor.

7. The detection system of claim 6 wherein the bidirectional communication between the base station and the sensor facilitates execution of a control routine.

8. The detection system of claim 7 wherein the control routine comprises at least one of a synchronization routine, a securitization routine, a configuration routine, and a failure safety routine.

9. The detection system of claim 1 wherein the sensor is configured to facilitate variation of the sensitivity of the detection signal receiver.

10. A detection system comprising:

a base station defining a detection area and configured to facilitate selective variation of the detection area, the base station comprising:

a first transmitter configured to transmit a detection signal at a first frequency; and a communication transceiver configured to transmit a first communication signal at a second frequency and to receive a second communication signal, the first frequency being less than the second frequency; and a sensor movable relative to the base station and comprising:

a detector configured to detect the detection signal; and a sensor transceiver configured to transmit the second communication signal at the second frequency and receive the first communication signal, the second communication signal being selectively transmitted in response to each of the detection signal and the first communication signal;

wherein movement of the sensor between the detection area and an area outside of the detection area affects detection of the detection signal and receipt of the first communication signal.

11. The detection system of claim 10 wherein the detection signal comprises a radio frequency signal, the first frequency is between about 100 kHz and about 150 kHz, the first and second communication signals comprise radio frequency signals, and the second frequency is between about 27 MHz and about 6 GHz.

12. The detection system of claim 10 wherein the communication transceiver and the sensor transceiver facilitate bidirectional communication between the base station and the sensor.

13. The detection system of claim 12 wherein the bidirectional communication between the base station and the sensor facilitates execution of at least one of a synchronization routine, a securitization routine, a configuration routine, and a failure safety routine.

14. A method for detection comprising:

transmitting a first detection signal from a base station at a first frequency;

moving a sensor relative to the base station;

defining a first detection area that is selectively variable;

receiving the first detection signal at the sensor if the sensor is within the first detection area; and selectively transmitting a communication signal from the sensor at a second frequency in response to the first detection signal, the first frequency being less than the second frequency.

15. The method of claim 14 further comprising:

coupling the base station to a machine;

coupling the sensor to an operator;

interrupting power to the machine if the base station receives the communication signal from the sensor in response to the first detection signal.

16. The method of claim 14 further comprising:

coupling the base station to a machine;

coupling the sensor to an operator;

activating an alarm if the base station receives the communication signal from the sensor in response to the first detection signal.

17. The method of claim 14 further comprising:

transmitting the first detection signal from the base station at a first power and a second power;

defining a second detection area;

receiving the first detection signal at the first power at the sensor if the sensor is within the first detection area;

receiving the first detection signal at the second power at the sensor if the sensor is within the second detection area; and selectively transmitting the communication signal from the sensor in response to at least one of the first detection signal at the first power and the first detection signal at the second power.

18. The method of claim 17 further comprising:

coupling the base station to a machine;

coupling the sensor to an operator;

interrupting power to the machine if the base station receives the communication signal from the sensor in response to the first detection signal at the first power; and permitting operation of the machine if the base station receives the communication signal from the sensor in response to the first detection signal at the second power.

19. The method of claim 17 further comprising:

coupling the base station to a machine;

coupling the sensor to an operator;

activating an alarm if the base station receives the communication signal from the sensor in response to the first detection signal at the first power; and deactivating the alarm if the base station receives the communication signal from the sensor in response to the first detection signal at the second power.

20. The method of claim 17 further comprising:

transmitting a second detection signal from the base station;

defining a third detection area;

receiving the second detection signal at the sensor if the sensor is within the third detection area; and selectively transmitting a communication signal from the sensor in response to the second detection signal.

21. The method of claim 20 further comprising:

coupling the base station to a machine;

coupling the sensor to an operator;

interrupting power to the machine if the base station receives the communication signal from the sensor in response to the first detection signal at the first power;

permitting operation of the machine if the base station receives the communication signal from the sensor in response to the first detection signal at the second power; and interrupting power to the machine if the base station receives the communication signal from the sensor in response to the second detection signal.

22. The method of claim 20 further comprising:

coupling the base station to a machine;

coupling the sensor to an operator;

activating an alarm if the base station receives the communication signal from the sensor in response to the first detection signal at the first power;

deactivating the alarm if the base station receives the communication signal from the sensor in response to the first detection signal at the second power; and activating the alarm if the base station receives the communication signal from the sensor in response to the second detection signal.

23. The method of claim 20 further comprising interrupting power to the machine if the base station does not receive a communication signal from the sensor.

24. The method of claim 14 further comprising varying a signal power of the first detection signal in order to vary the first detection area.

25. The method of claim 24 wherein varying the signal power of the first detection signal comprises at least one of varying a voltage of the first detection signal, varying a current of the first detection signal, varying a duty cycle of the first detection signal, modulating a pulse width of the first detection signal, and varying a frequency of the first detection signal.

26. A proximity control system for an apparatus comprising:

an electronic device associated with the apparatus;

a base station coupled with the apparatus and operably coupled with a control device, the base station defining a first detection area and being configured to transmit a detection signal at a first frequency and further configured to facilitate selective variation of the first detection area; and a sensor configured for selective association with an operator of the apparatus, the sensor being configured to detect the first detection signal and transmit a communication signal at a second frequency in response to the detection signal, wherein movement of the sensor between the first detection area and an area outside of the first detection area affects detection of the detection signal and wherein the first frequency is less than the second frequency;

wherein the base station is configured to actuate the electronic device in response to the communication signal from the sensor.

27. The proximity control system of claim 26 wherein the electronic device comprises a cut-off switch coupled with the device and configured to facilitate interruption of power to the apparatus.

28. The proximity control system of claim 26 wherein the base station defines a second detection area and is configured to transmit the detection signal at a first power and a second power, wherein, if the sensor is within the first detection area, the sensor transmits the communication signal to the base station in response to the detection signal at the first power and wherein if the sensor is within the second detection area, the sensor transmits the communication signal to the base station in response to the detection signal at the signal power.

29. The proximity control system of claim 26 wherein the apparatus comprises an industrial machine.

* * * * *